US005794800A

United States Patent [19]

Carmo et al.

[11] Patent Number: 5,794,800

[45] Date of Patent: Aug. 18, 1998

[54] DISPLAY STRIP FOR ELONGATED ARTICLES FORMED INTO HANKS

[75] Inventors: Robert A. Carmo, Placentia; Kenneth F. Morre, Long Beach, both of Calif.

[73] Assignee: Leviton Manufacturing Co., Inc., Little Neck, N.Y.

[21] Appl. No.: 816,231

[22] Filed: Mar. 13, 1997

Related U.S. Application Data

[63] Continuation of Ser. No. 291,654, Aug. 17, 1994, abandoned.

[51] Int. Cl.[6] ..... A47F 5/08

[52] U.S. Cl. ..... 211/113; 211/87

[58] Field of Search ..... 211/113, 118, 211/89, 87; 33/755, 767, 769, 770; 242/376, 407, 614, 579, 580.1; 248/90, 317, 74.3, 205.2

[56] References Cited

U.S. PATENT DOCUMENTS

| | | | |
|---|---|---|---|
| 2,288,706 | 7/1942 | Herr | 211/87 |
| 2,510,939 | 6/1950 | Carlson | 242/84.9 |
| 2,614,769 | 10/1952 | Nicholson | 242/84.9 |
| 2,889,934 | 6/1959 | Vidach | 211/113 |
| 2,941,672 | 6/1960 | Lathrop | 211/87 |
| 4,878,586 | 11/1989 | Bancroft et al. | 211/59.1 |
| 5,117,988 | 6/1992 | Daniels | 211/113 |
| 5,284,259 | 2/1994 | Conway et al. | 211/113 |

FOREIGN PATENT DOCUMENTS

| | | | |
|---|---|---|---|
| 186407 | 9/1922 | United Kingdom | 211/87 |
| 1002937 | 9/1965 | United Kingdom | 211/113 |

*Primary Examiner*—Ramon O. Ramirez
*Assistant Examiner*—Anita M. King
*Attorney, Agent, or Firm*—Paul J. Sutton

[57] ABSTRACT

A display strap in the form of a flat belt of flexible material into which a number of tongues are cut each individually deflectable out of the plane of the strap about an unsevered end used as a hinge. The tongue has a cross-member at its free end and a portion of reduced width adjacent the cross-member. Two part slots are provided adjacent the hinge to receive the cross-member and then permit the tongue to be displaced into locking engagement between the cross-member and the rear surface of the strap. The looped tongue is employed to support elongate articles formed into multi-turn hanks.

An alternative locking slot arrangement employs a tapered width locking slot which requires the tongue to be rotated to enter the locking slot making accidental opening of the loop very difficult.

5 Claims, 4 Drawing Sheets

DISPLAY STRIP FOR ELONGATED ARTICLES FORMED INTO HANKS

This is a continuation of application Ser. No. 08/291,654 filed on Aug. 17, 1994 now abandoned.

BACKGROUND OF THE INVENTION

1. Field of Invention

The invention is directed to the field of merchandising and more particularly to the display for sale of elongate articles such as electrical conductors, electrical extension cords, hose, tubing and the like formed into multi-turn hanks.

2. Description of the Prior Art

At present elongated articles are often formed into multi-turn hanks and fastened by looping the end portion of the article about the hank with the end pulled through the hank loop at one end. Wire ties can also be placed about different portions of the hank and used also to fix the hank to a display card, or a light-weight sleeve can be fastened about the center of the hank. The hanks without an attached display card are often placed in wire bins and the continuous handling of such hanks causes them to open and the elongate articles to become entangled, making such articles unattractive for sale. Hanks with display card attached are often placed upon wire display racks using a wire arm which passes through an aperture in the display card. Since these racks often are made to be rotated by a customer reviewing all of the items on such rack, individual display cards often fall off due to the way in which the rack is rotated. Also the wire arms bend, allowing display cards to fall from the rack.

SUMMARY OF THE INVENTION

The present invention overcomes the difficulties noted with respect to known prior art devices by providing a display strap which can be conveniently hung upon a wall or display stand and on which individual elongate articles, each formed into a separate multi-turn hank, can be mounted so that each hank is displayed and each hank is separately removable and replaceable with respect to the display strap without interfering with the display of the remaining hanks.

The display strap is a flat belt of a flexible material such as rubber or plastic and is made wide enough to support the, weight of the hanks and long enough to accommodate the desired number of hanks or fit in the available space. At a first end the strap has an enlarged area top to which product data, prices, etc. can be affixed or written and a hole to receive a hangar to affix the strap to a wall or display stand. A number of tongues are formed along the strap length and severed from the strap at a second end and along two generally parallel marginal edges. This permits each tongue to be displaced out of the plane of the strap with the unsevered first end acting as a living hinge.

The second end of each tongue is formed with a cross-member wider than the tongue width and a notch in the marginal edges of the tongue near the cross-member provides, a region of tongue width less than the remainder. Adjacent each tongue first end is a locking means made up of a first slot portion having a width to accept the cross-member and a locking slot to accept the tongue at its notches. The locking slot can have a uniform width throughout or have a narrower entry with outwardly tapering side walls which end at a width to receive the tongue at its notches.

The tongue is displaced outwardly from the strap and looped about the hank to be supported. The cross-member is inserted into the first slot and advanced until the tongue portion between the notches is opposite the entrance to the locking slot at which time the tongue is pushed downwardly until it rests on the bottom of the locking slot. Where the entrance to the locking slot is less than the tongue width at the notches, the tongue is twisted 90° with respect to the entrance to the locking slot and then moved downwardly. Adjacent the locking slot bottom the tongue is twisted back to its original orientation to lock the tongue. To remove a hank the tongue is moved and twisted in a manner opposite to the manner of installation. It is an object of this invention to provide a novel means for displaying elongate articles formed into multi-turn hanks.

It is an object of this invention to provide a novel means for displaying elongate articles formed into multi-turn hanks where each hank may be installed or removed from such means without interfering with other hanks on such means.

It is still another object of this invention to provide a novel means for displaying elongate articles formed into multi-turn hanks employing a number of tongues formed on said means.

It is yet another object of this invention to provide a novel means for displaying elongate articles formed into multi-turn hanks employing a number of tongues formed on said means, each tongue being selectively lockable using locking slots provided on said means after such tongues have been looped about a hank.

Other objects and features of the invention will be pointed out in the following description and claims and illustrated in the accompanying drawings, which disclose, by way of example, the principles of the invention, and the best modes presently contemplated for carrying them out.

BRIEF DESCRIPTION OF THE DRAWING

In the drawings in which similar elements are given similar reference characters.

DESCRIPTION OF THE PREFERRED EMBODIMENTS

Figure 1:
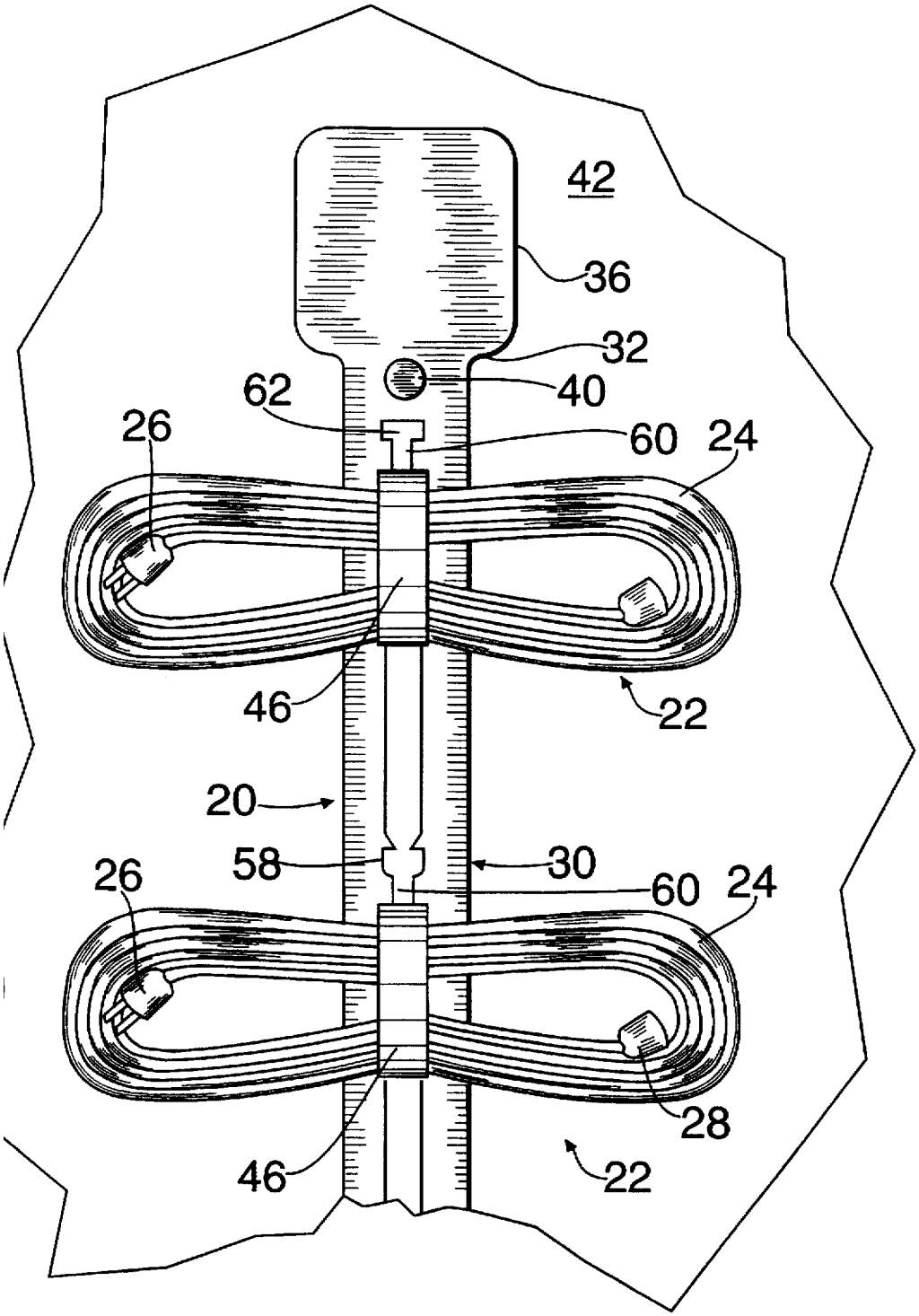
FIG. 1 is a fragmentary front elevational view of a display strap constructed in accordance with the concepts of the invention mounted on a wall and showing the mounting of two electrical extension cords formed into multi-turn hanks.

Turning now to FIGS. 1, 2, 3, 4, 8 and 9 there is shown a display strap 20 for displaying a plurality of elongate articles each formed into a multi-turn hank 22. As shown in FIG. 1, each of the hanks 22 is an electrical extension cord made up of a length of insulated multi-conductor cable 24 terminated at one end in a male plug 26 and at the other in a female socket 28. Although the hanks 22 are shown and described as electrical extension cords for ease of discription, the hanks 22 could be other elongate articles such as unterminated electrical cable, rubber or plastic hose and tubing, wire, rope or the like. The display strap 20 has a main body portion 30 and an enlargement 36 at a first end 32 and a second end 34 having rounded corners (see FIG. 2). The enlargement 36 can be used to provide information about the articles in the hanks 22. This can be done by attaching a data card (not shown) to enlargement 36 or by writing directly upon it as with a grease pencil. Also adjacent first end 32 there is placed an aperture 38 through which a fastener 40 is passed to fix display strap 20 to a wall 42. The aperture 38 could also be used to mount display strap 20 on an arm of a display stand (not shown).

Figure 2:
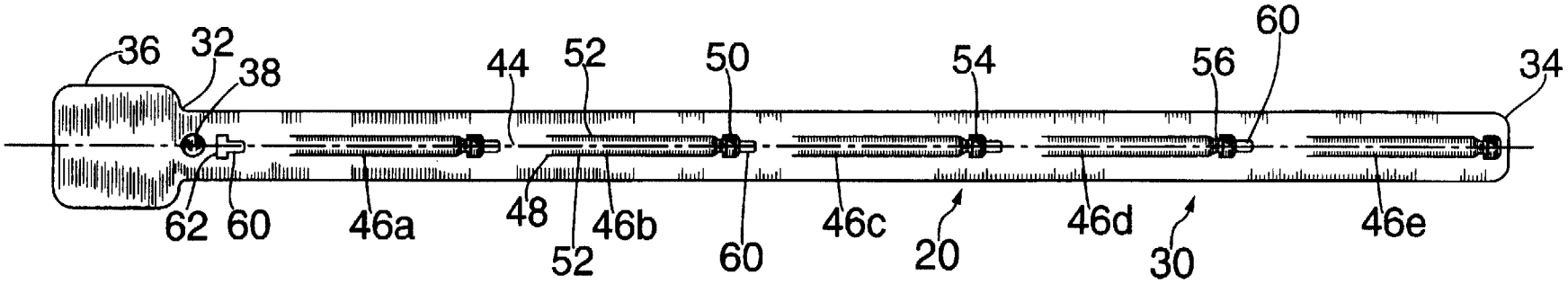
FIG. 2 is a top plan view of a display strap according to the concepts of the invention, with provision for mounting five hanks.
Figure 4:
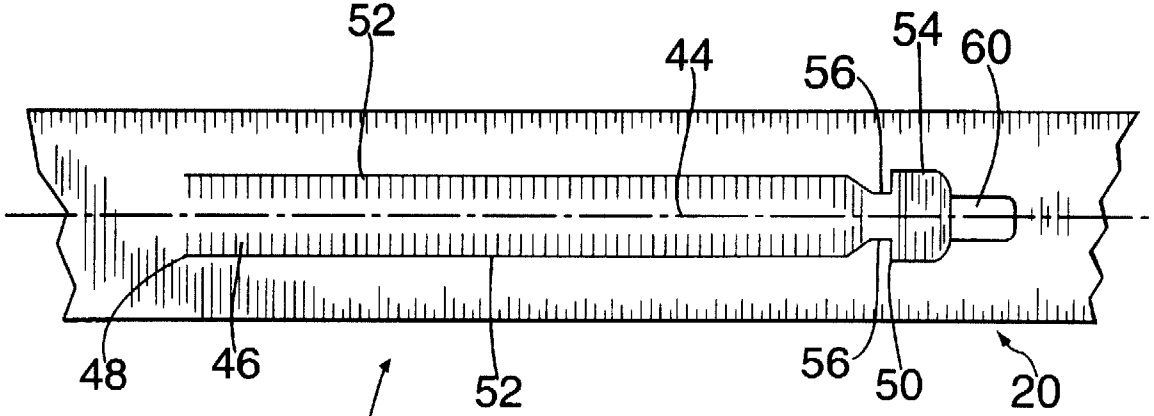
FIG. 4 is an enlarged fragmentary top plan view of a portion of the display strap of FIG. 2 showing a tongue and the locking slot for all tongues except the topmost and bottommost tongues.
Figure 3:
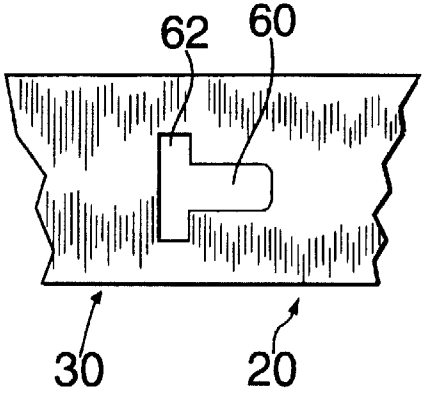
FIG. 3 is an enlarged fragmentary top plan view of a portion of the display strap of FIG. 2 showing the topmost locking slots.
Figure 5:
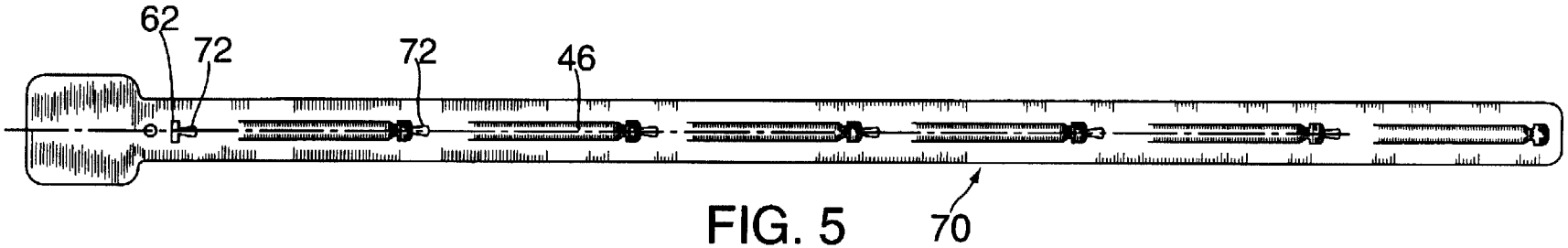
FIG. 5 is a top plan view of a second embodiment of a display strap constructed according to the concepts of the invention with provision for mounting six hanks.
Figure 7:
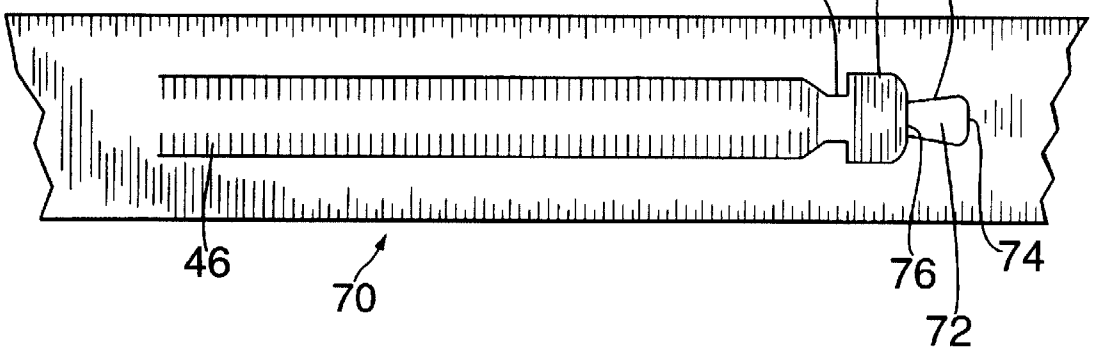
FIG. 7 is an enlarged fragmentary top plan view of a portion of the display strap of FIG. 5 showing a tongue and the locking slot for all tongues except the topmost and the bottommost tongues.
Figure 6:
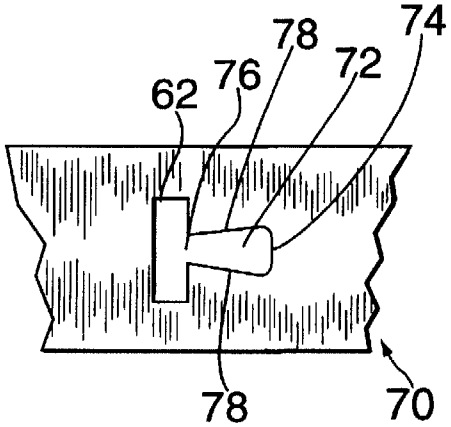
FIG. 6 is an enlarged fragmentary top plan view of a portion of the display strap of FIG. 5 showing the topmost locking slot.

Formed along a central longitudinal axis 44 of body portion 30 between first end 32 and second end 34 are a number of tongues 46 each having a first end 48, a second end 50 and two generally parallel marginal edges 52 therebetween. The tongues 46 are severed from the strap body portion 30 along both marginal edges 52 and adjacent said second end 50 so that the tongues 46 can be displaced out of the plane of the paper of FIG. 2 with the unsevered first end 48 acting as a living hinge. Each of the tongues 46 end in a cross-member 54 which has a width greater than the width of tongue 46 across body portion 30. Adjacent second end 50, the marginal edges 52 of tongues 46 are notched as at 56 to give a tongue width less than the width of the tongues across the marginal edges 52. Adjacent the cross-member 54 of tongues 46 except for tongue **46*e* are locking slots 60 which extend from entry slots 58 and 62. The entry slots 58 have a width slightly in excess of the width of the cross-member 54 so that the cross-member 54 can pass through entry slot 58 and 62. The locking slot 60 has a width slightly in excess of the width of the tongue 46 between the notches 56. As shown in FIGS. 2 and 3 the entry slot 62 for the tongue 46*a* is a rectangle with square corners whereas the entry slots 58 for the remainder of the tongues 46 are the shape of the cross-members 54 having rounded lower corners. Also, there is no locking slot 60 adjacent the cross-member 54 of tongue 46*e* because there is no tongue 46** to be placed therein.

Figure 8:
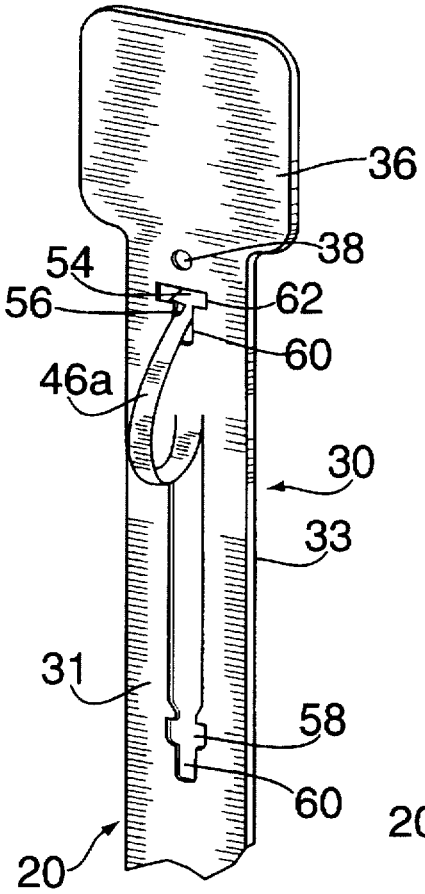
FIG. 8 is a fragmentary front right isometric view of a display strap according to FIG. 2 with a tongue formed into a loop and positioned in the entry slot of the locking means.
Figure 9:
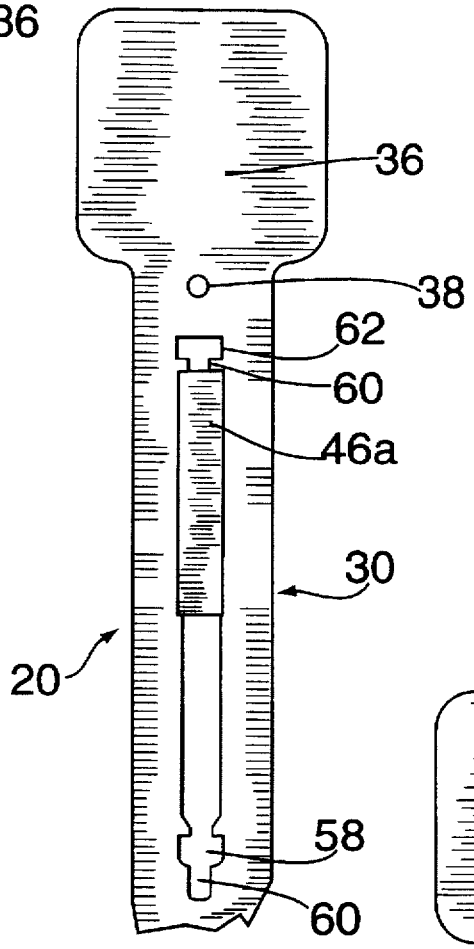
FIG. 9 is a fragmentary front elevational view of the display strap of FIG. 8 in the fully locked position.
Figure 10:
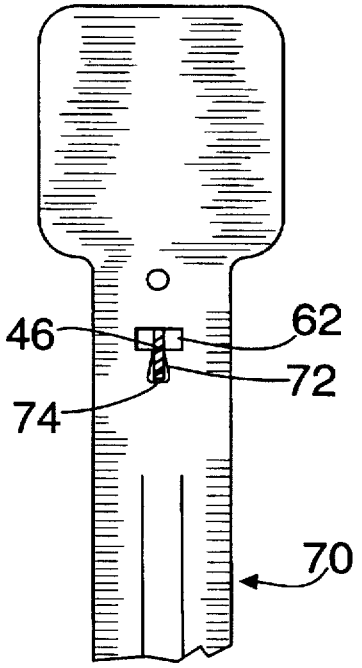
FIG. 10 is a fragmentary front elevational view of the display strap of FIG. 5 with the tongue loop removed to display the installation of the locking tab into the locking slot.

To use the display strap 30, reference is made to FIGS. 8 and 9. Tongue **46*a*, for example is pushed from body portion 30 rear surface 33 out of the plane of body portion 30 front surface 31 and the cross-member 54 is grasped and the tongue 46*a* is looped about the hank (not shown). Cross-member 54 is placed in entry slot 62, at body portion 30 front surface 31 (see FIG. 8) and the tongue 46*a* advanced through entry slot 62 until the tongue portion between notches 56 is opposite the entry to locking slot 60. At this point, a downward force is applied to tongue 46*a* which causes the tongue portion between notches 56 to enter the locking slot 60. The cross-member 54 now engages the rear surface 33 of body portion 30 to lock the tongue 46*a* in place (as shown in FIG. 9). The weight of the hank 22 tends to keep the cross-member 54 in place assuring that tongue 46*a* will remain in its locked position as shown in FIG. 9. The tongue 46*a* can be unlocked merely be pushing up on tongue 46*a* until cross-member 54 is again in entry slot 62 at which time the tongue 46*a* can be withdrawn from entry slot 62. The operation for the tongues 46*b* to 46*e* is the same except that the entry slots 58 are higher than entry slot 62 because they are actually the part of body portion 30 vacated by the cross-member 54**.

The body portion 30 can be fabricated from flexible materials such as natural or synthetic rubber, thermoset or thermoplastic materials or the like. In one sample, body portion 30 was made of nylon and had a width of 2½ inches and a thickness of 1/16 of an inch. The length of body portion 30 was 62½ inches for a display strap 20 able to handle six hanks 22. The tongues 46 were ¾ of an inch wide and 6½ inches long. Cross-member 54 was ⅞ of an inch wide and the tongue between notches 56 was ½ inch. Entry slots 58 and 62 had widths slightly in excess of ⅞ of an inch and the locking slot 60 had a width in excess of ½ inch and a height of ¾ of an inch. Enlargement 36 was 5 inches by 5 inches.

To insure that tongues 46 do not become unlocked accidentally a different locking slot can be used as shown by display strap 70 shown in FIGS. 5, 6, 7 and 10. Locking slot 72 of strap 70 has a base 74 having a width slightly in excess of the width of the tongue 46 between notches 56 and an entrance 76 narrower than the width of the tongue 46 between notches 56. The sides 78 of locking slot 72 between entry 76 and base 74 are outwardly inclined. Entry slot 62 has a width slightly in excess of the width of cross-member 54.

To lock tongue 46, the cross-member 54 is placed in entry slot 62 and the tongue 46 advanced until the tongue 46 portion between notches 56 is in entry slot 62. At this point the tongue 46 is rotated 90° clockwise using the cross-member 54 (see FIG. 10). The tongue 46 is now pushed towards base 74 of slot 72 and allowed to rotate counter-clockwise 90° to return to its normal orientation placing cross-member 54 in locking contact with rear wall 33 of strap body portion 30. Upward forces alone can not dislodge tongue 46, only a combination of rotation and translation of tongue 46 will permit it to be unlocked.

While there have been shown and described and pointed out the fundamental novel features of the invention as applied to the preferred embodiments, it will be understood that various omissions and substitutions and changes of the form and details of the devices illustrated and in their operation may be made by those skilled in the art, without departing from the spirit of the invention.

The invention claimed is:

1. A device for displaying elongate articles each formed into a multi-turn hank comprising:

a) a flat strap member formed of a flexible plastic material having a uniform thickness and width, a first end and a second end for attachment to said articles arranged to extend transverse to the longitudinal axis of said strap member;

b) at least two tongue members in said strap member each aligned with the longitudinal axis of said strap member, each having a first end and a second end and two substantially parallel marginal edges extending from said first end to said second end and defining a first width therebetween; said at least two tongue members each defined by a severed top edge at said second end and severed marginal edges to permit each of said at least two tongue members to be selectively displaced out of the plane of the strap member about the unsevered first end as a hinge;

c) a locking tab on each of said at least two tongue members adjacent their respective second ends and extending transverse to the longitudinal axis of said strap member and having a second width greater than said first width;

d) a first slot portion adjacent said second end of each of said at least two tongue members having a width substantially equal to said second width; and e) a second slot portion adjacent said second end of each of said at least two tongue members each communicating with an associated first slot portion, said second slot portions having a width less than said first width whereby said tongue members are each selectively locked in place about a hank arranged to be placed adjacent said device by introducing said locking tab into said first slot portion and moving said tongue into and along said second slot portion.

2. The device for displaying, as set forth in claim 1, wherein entrances to said second slot portions are narrower than said second width and said tongue members must be rotated 90° with respect to the plane of the strap member to permit each of said at least two tongue members to enter their respective associated second slot portions.

3. The device for displaying, as set forth in claim 2, wherein said second slot portions each have outwardly tapered side walls extending from said entrance to said second slot portion to a free end of said second slots.

4. The device for displaying, as set forth in claim 3, wherein said two marginal edges of said tongue member adjacent said second end are notched to provide a third width, said third width narrower than said first width to permit said notched potion of said tongue member to move along said second slot portion.

5. The device for displaying, as set forth in claim 1, wherein the locking tab of the second of said at least two tongue members is positioned in the first slot portion of the first of said at least two tongue members and moved into the second slot portion of the first of said at least two tongue members to lock the second of said at least two tongue members about a hank placed adjacent said second of said at least two tongue members.

* * * * *